US005417175A

United States Patent [19]

Clausin

[11] Patent Number: 5,417,175

[45] Date of Patent: May 23, 1995

[54] DEVICE FOR ADJUSTABLE HEIGHT FASTENING OF THE TACK POINT OF A SAIL ON THE SAIL REEFER

[75] Inventor: Pierre Clausin, Ville D'Avray, France

[73] Assignee: Proengin S.A., Saint Cyr L'Ecole, France

[21] Appl. No.: 135,349

[22] Filed: Oct. 13, 1993

[30] Foreign Application Priority Data

Dec. 3, 1992 [FR] France ..... 92 14790

[51] Int. Cl.[6] ..... B63H 9/04

[52] U.S. Cl. ..... 114/106

[58] Field of Search ..... 114/102, 103, 104, 105, 114/106, 107

[56] References Cited

U.S. PATENT DOCUMENTS

| | | | |
|---|---|---|---|
| 3,800,729 | 4/1974 | Keeler | 114/106 |
| 3,958,523 | 5/1976 | Holmes et al. | 114/106 |
| 4,080,917 | 3/1978 | Alter et al. | 114/106 |

FOREIGN PATENT DOCUMENTS

| | | |
|---|---|---|
| 2584370 | 7/1985 | France . |
| 2641250 | 12/1989 | France . |
| 1407662 | 4/1973 | United Kingdom . |
| 2051718 | 6/1980 | United Kingdom . |

*Primary Examiner*—Stephen P. Avila
*Attorney, Agent, or Firm*—Browdy and Neimark

[57] ABSTRACT

The device for adjustable height fastening of the tack point of a sail on the sail reefer according to the invention uses a sail tack point fastening ring, mounted slidably on the reefer tube, and a screw enabling this ring to be immobilized on the tube at the required height. The invention enables sail tension to be adjusted without recourse to a pulley block.

4 Claims, 1 Drawing Sheet

DEVICE FOR ADJUSTABLE HEIGHT FASTENING OF THE TACK POINT OF A SAIL ON THE SAIL REEFER

BACKGROUND OF THE INVENTION

1. Field of the Invention

This invention relates to sailing and particularly to sail reefers.

2. Description of the Prior Art

In known jib reefers, the lower part of the sail situated near the bolt rope, still called tack point, is connected to a fastening attachment situated near the bottom of the reefer, usually above the drum or reduction gear which rotates the tube. This attachment does not enable the tension of the bolt rope to be adjusted, i.e. the tension of the sail, when the upper part of the latter is attached at the level of its halyard point to the end of the reefer tube by a locking device. Sail tension is then ensured by a pulley block interposed between the tack point and the fastening attachment on the reefer. However, this pulley block has the drawback of not maintaining the tack point of the sail against the reefer tube. Furthermore, on sail reefers whose drum is situated below the deck, the tack point must be situated above the deck. It is therefore necessary to provide a connection part between the drum mechanism and this tack point in order to raise this tack point above the deck. As the distance between the drum mechanism and the tack point is different according to the types of boat equipped, the connection tube must have lengths adapted specially to the type of boat, which makes series production difficult, as the length of the tubes has to be specially adapted.

OBJECT OF THE INVENTION

The main object of this invention is to remedy the preceding disadvantages, particularly to provide a device for fastening to the sail reefer, intended to tack the sail, this device being height adjustable so as to ensure, in the first example, sail tension adjustment without recourse to a pulley block, and, in the second example, to enable series production of sail reefers adaptable to all types of boats when the drum must be situated below deck.

SUMMARY OF THE INVENTION

Accordingly, a device therein comprises tack point fastening means mounted on the reefer tube, or in an equivalent manner, on a connection tube prolonging the mechanism ensuring rotation of the reefer tube, by way of a means enabling its height to be adjusted.

BRIEF DESCRIPTION OF THE DRAWINGS

Further features and advantages of the invention will be described hereafter, by way of non-limiting examples, in reference to the accompanying drawings in which.

DESCRIPTION OF THE PREFERRED EMBODIMENTS

Figure 1:
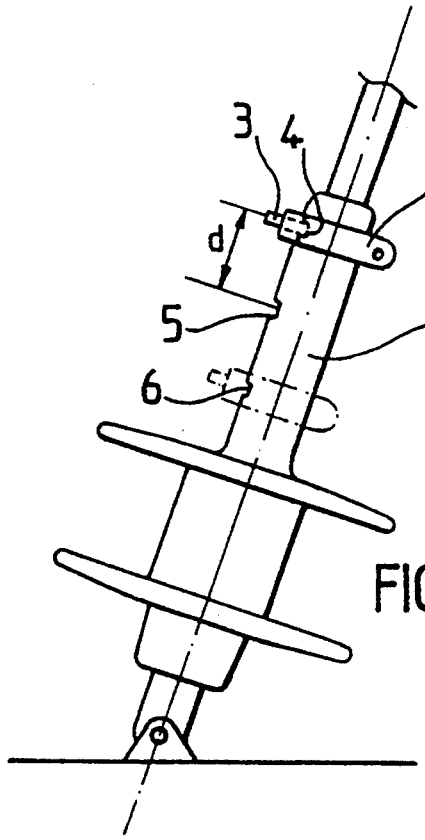
FIG. 1 is an upright projection of the lower part of the sail reefer, equipped with its drum.

FIG. 1 shows a simple embodiment of the invention, according to which the fastening of the tack point is carried out by a ring 1 mounted slidably on the tube 2 of the sail reefer or, in an equivalent manner, on an extension of the drum mechanism or reduction gear serving to rotate the tube.

Immobilization on the tube 2 at the required height is ensured by a screw 3 which penetrates into holes 4, 5, 6 spaced apart so as to position the ring 1 differently. In this example, between the positionings ensured in hole 4 and in hole 5, the adjustment distance is seen to be d.

Figure 2:
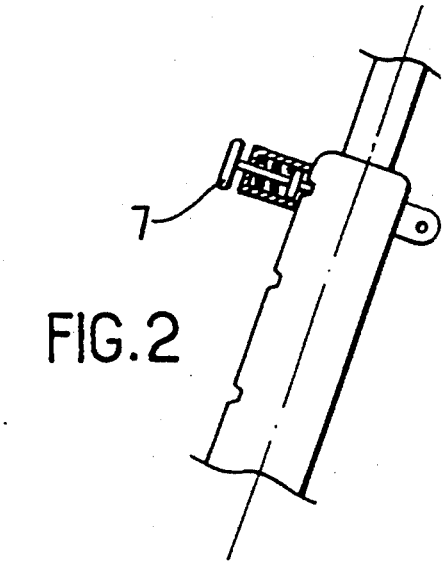
FIG. 2 is a detailed embodiment of the locking of the sliding ring to which the sail tack is fastened.

FIG. 2 represents an embodiment enhancing the previous system by replacing the immobilization screw by a retractable lock enabling instantaneous adjustment of the height of the attachment without recourse to a tool. This system uses a radial finger 7 pulled back by a spring, whose end can engage in the dead holes made in the tube 2. The finger 7 comprises a head enabling it to be manually operated.

Figure 3:
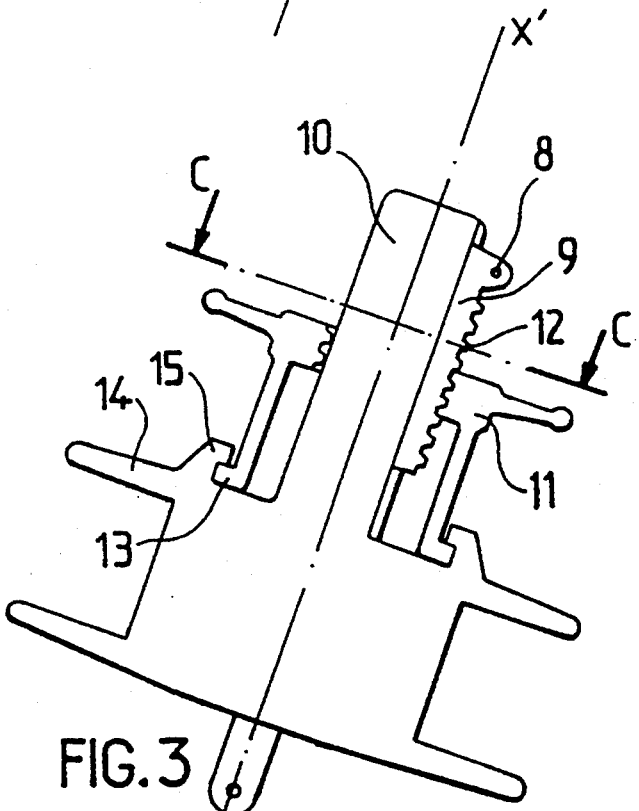
FIG. 3 is an upright projection of another embodiment of the lower part of a sail reefer.
Figure 4:
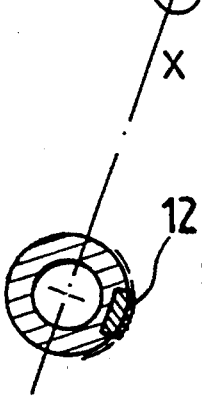
FIG. 4 is a section along C—C in FIG. 3.

FIG. 3 represents an embodiment of the invention which ensures continuous adjustment of the fastening of a tack point 8 which is part of a slide rail 9: the slide rail 9 moves, within a groove machined in the tube 10, by way of the action of a wheel 11 comprising an interior threading, said threading cooperating with portions of threading 12 which are part of the slide rail, as represented in FIG. 4. The wheel 11 is axially maintained on the sail reefer along the axis XX' by a plunged boss 13 maintained by the drum 14 by means of a flange 15, an axial clearance enabling the wheel to rotate.

Figure 5:
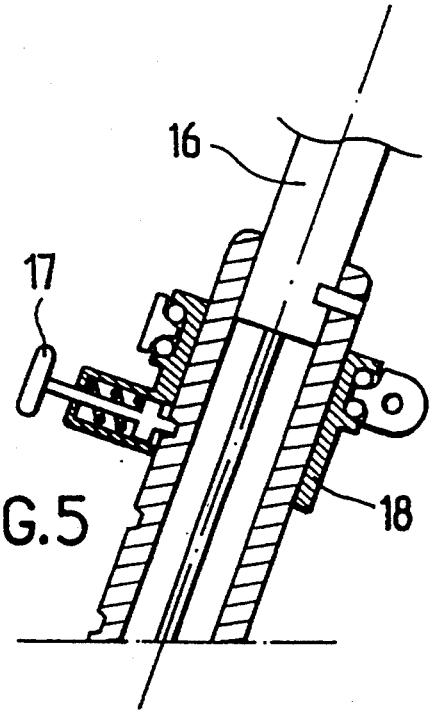
FIG. 5 is a partial axial section of another embodiment of an adjustable tack point comprising a swivel block.

FIG. 5 represents an embodiment of the invention which illustrates the possibility of adapting a fastening attachment of a tack point rotating freely about the tube 16 of the reefer, in order to be able to pull in the slack on the sail. In this instance, the height adjustment is ensured by a lock 17 similar to the lock 7 used in FIG. 2. The freedom of rotation is ensured by a swivel block 18 whose outer part bears the tack point.

I claim:

1. A sail reefer comprising a rotating tube about which a sail having a tack point is furled, a mechanism for rotating said tube, a sliding ring mounted slidably on the tube and provided with means for fastening said tack point, and fixing means for axially fixing said ring on said tube in several positions spaced apart with respect to each other, wherein said fixing means comprises a plurality of holes provided on said tube and a screw which may be screwed through said sliding ring so as to penetrate into one of said holes.

2. A sail reefer comprising a rotating tube about which a sail having a tack point is furled, a mechanism for rotating said tube, a sliding ring mounted slidably on the tube and provided with means for fastening said tack point, and fixing means for axially fixing said ring on said tube in several position spaced apart with respect to each other, wherein said fixing means comprises a retractable lock having a radial finger pulled back by a spring so as to engage in a hole provided in the tube.

3. A device according to claim 1, wherein said fastening means comprises a swivel block freely rotating about said ring and having an outer part which bears said tack point.

4. A sail reefer comprising a rotating tube provided with an axial groove and about which sail provided with a tack point is furled, a slide rail moving in the groove and provided with means for fastening said tack point as well as a threaded portion and a rotating wheel comprising an inner threading which engages said threaded portion, and means for axially maintaining said wheel while allowing pivoting thereof about said tube.

* * * * *